US006139310A

United States Patent [19]

Mahoney et al.

[11] Patent Number: 6,139,310

[45] Date of Patent: Oct. 31, 2000

[54] SYSTEM FOR PRODUCING A SINGLE COHERENT JET

[75] Inventors: William John Mahoney, Dobbs Ferry; John Erling Anderson, Somers, both of N.Y.

[73] Assignee: Praxair Technology, Inc., Danbury, Conn.

[21] Appl. No.: 09/441,095

[22] Filed: Nov. 16, 1999

[51] Int. Cl.[7] ..... F23D 14/38; F23D 14/48

[52] U.S. Cl. ..... 431/8; 431/187; 431/2; 239/423; 239/433

[58] Field of Search ..... 431/187, 8, 9, 431/10, 350, 278, 115, 116, 2; 148/202, 194, 203, 204, 205; 239/418, 433, 423

[56] References Cited

U.S. PATENT DOCUMENTS

| | | | |
|---|---|---|---|
| 1,799,612 | 4/1931 | Coberly . | |
| 2,195,384 | 3/1940 | Zobel et al. . | |
| 3,427,151 | 2/1969 | Koudelka et al. | 75/59 |
| 4,426,224 | 1/1984 | Shimme et al. | 75/49 |
| 4,622,007 | 11/1986 | Gitman | 431/10 |
| 4,797,087 | 1/1989 | Gitman | 431/10 |
| 4,830,681 | 5/1989 | Arnot et al. . | |
| 5,714,113 | 2/1998 | Gitman et al. | 266/182 |
| 5,814,125 | 9/1998 | Anderson et al. | 75/414 |
| 5,823,762 | 10/1998 | Anderson et al. | 431/8 |

FOREIGN PATENT DOCUMENTS

| | | | |
|---|---|---|---|
| 866139 | 9/1998 | European Pat. Off. . | |
| 874192 | 10/1998 | European Pat. Off. . | |
| 2133214 | 11/1972 | France | 431/8 |
| 89/02051 | 3/1989 | WIPO | 431/8 |

*Primary Examiner*—Carl D. Price
*Attorney, Agent, or Firm*—Stanley Ktorides

[57] ABSTRACT

A system for establishing a single coherent gas jet from a plurality of initial gas jets ejected from a single lance wherein the initial gas jets are themselves coherent, are angled inward, and are surrounded by a flame envelope. The initial coherent gas jets merge to form a single coherent jet and the gases of the initial gas jets do not substantially interact within this single coherent jet for the length of the resulting single coherent gas jet.

13 Claims, 5 Drawing Sheets

SYSTEM FOR PRODUCING A SINGLE COHERENT JET

TECHNICAL FIELD

This invention relates generally to the flow of gas. The invention enables the flow of more than one gas stream from a single lance such that the gas streams converge and form a single coherent jet.

BACKGROUND ART

It is often desired to establish a flow of gas. For example, a flow of gas may be injected into a liquid for one or more of several reasons. A reactive gas may be injected into a liquid to react with one or more components of the liquid, such as, for example, the injection of oxygen into molten iron to react with carbon within the molten iron to decarburize the iron and to provide heat to the molten iron. Oxygen may be injected into other molten metals such as copper, lead and zinc for smelting or refining purposes or into an aqueous liquid or hydrocarbon liquid to carry out an oxidation reaction. A non-oxidizing gas, such as an inert gas, may be injected into a liquid to stir the liquid in order to promote, for example, better temperature distribution or better component distribution throughout the liquid.

It is often desirable to use more than one gas stream in an operation. For example an oxidant stream, such as oxygen, and a fuel stream, such as natural gas, could be provided into a reaction space or into a liquid wherein they would combust to generate heat. While the oxidant and the fuel could be so provided from the provision device in a single mixed stream, this is generally not preferred for safety reasons.

The plurality of gas streams may converge and interact. Especially where the gas streams form a combustible mixture such as in the situation discussed above, it is desirable that they pass through a significant distance from the provision device. Moreover, in the case where the gases from the plurality of gas streams interact within a liquid, such as molten metal or an aqueous liquid, it is desirable that the gases penetrate deeply within the liquid to enhance the effect of their interaction.

Accordingly, it is an object of this invention to provide a system whereby gases from a plurality of gas streams may be passed a long distance from the device from which the plurality of gas streams are provided.

It is another object of this invention to provide a system whereby gases from a plurality of gas streams may be passed effectively into a liquid after passing a long distance from the device from which the plurality of gas streams are provided.

SUMMARY OF THE INVENTION

The above and other objects, which will become apparent to those skilled in the art upon a reading of this disclosure, are attained by the present invention, one aspect of which is:

A method for establishing a single coherent gas jet from a plurality of gas streams comprising:

(A) providing a lance having an axis and having an end with a plurality of nozzles, each of said nozzles having an output opening for passing gas from the nozzle;

(B) passing gas in a jet out from each nozzle output opening and forming a plurality of initial coherent gas jets, each initial coherent gas jet flowing from a nozzle output opening at an inward angle to the lance axis;

(C) passing fuel and oxidant in at least one stream out from the lance end and combusting the said fuel with the said oxidant to form a flame envelope around the plurality of initial coherent gas jets;

(D) flowing the plurality of initial coherent gas jets together and forming a single coherent gas jet from the plurality of initial coherent gas jets; and (E) extending the flame envelope from around the plurality of initial coherent gas jets so as to be around the single coherent gas jet.

Another aspect of the invention is:

Apparatus for establishing a single coherent jet from a plurality of gas streams, said apparatus comprising a lance having an axis and having an end with a plurality of nozzles, each of said nozzles having an axis at an inward angle to the lance axis, and means for passing at least one of fuel and oxidant out from the lance peripheral to said plurality of nozzles.

As used herein the term "annular" means in the form of a ring.

As used herein the term "flame envelope" means a combusting stream coaxially around at least one other gas stream.

As used herein the term "coherent gas jet" means a gas stream whose diameter remains substantially constant.

As used herein the term "length" when referring to a gas jet means the distance from the formation of the gas jet to the intended impact point of the gas jet.

The numerals in the Figures are the same for the common elements.

DETAILED DESCRIPTION

Figure 1:
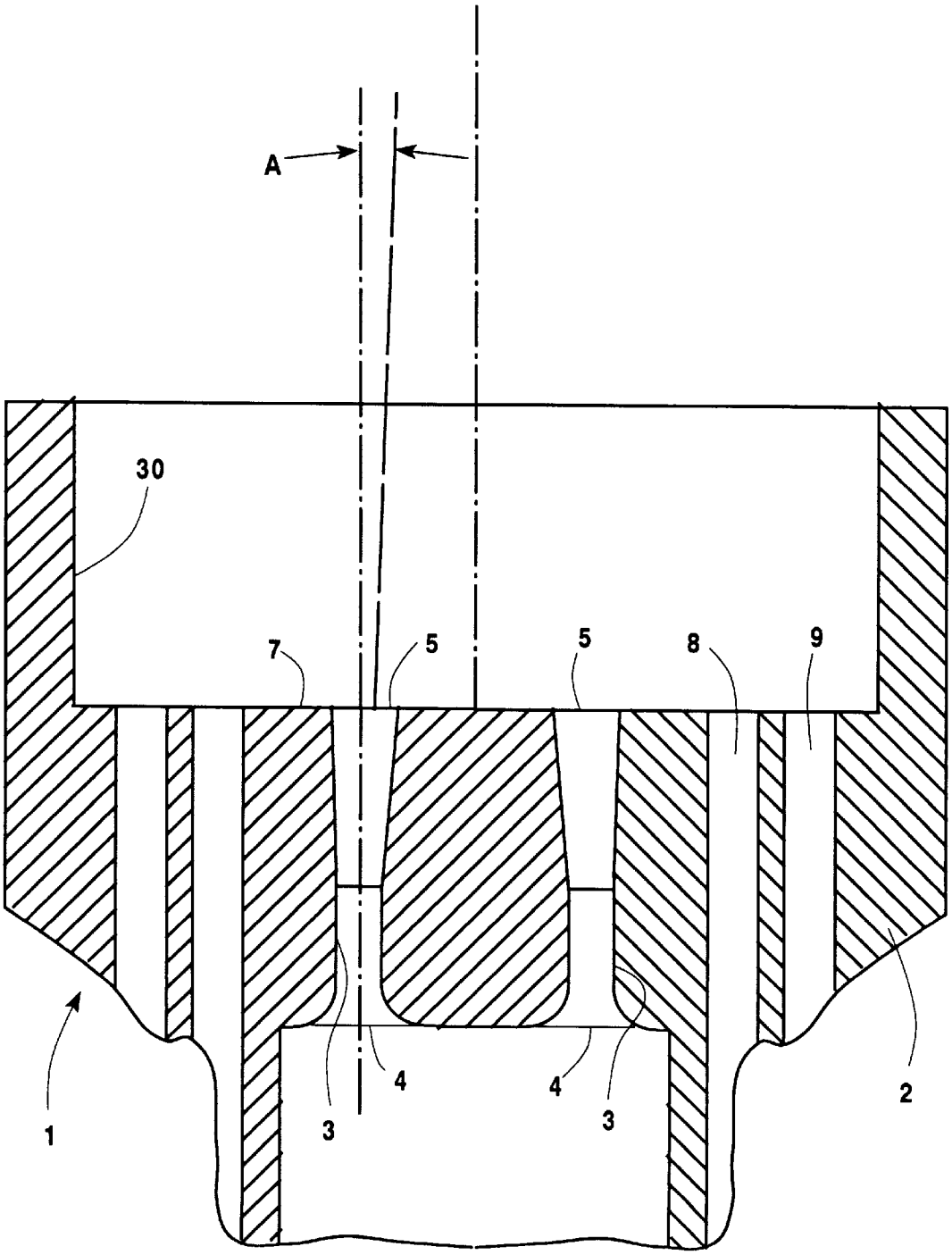
FIG. 1 is a cross sectional view of one preferred embodiment of the end or tip section of a lance which may be used in the practice of this invention.
Figure 2:
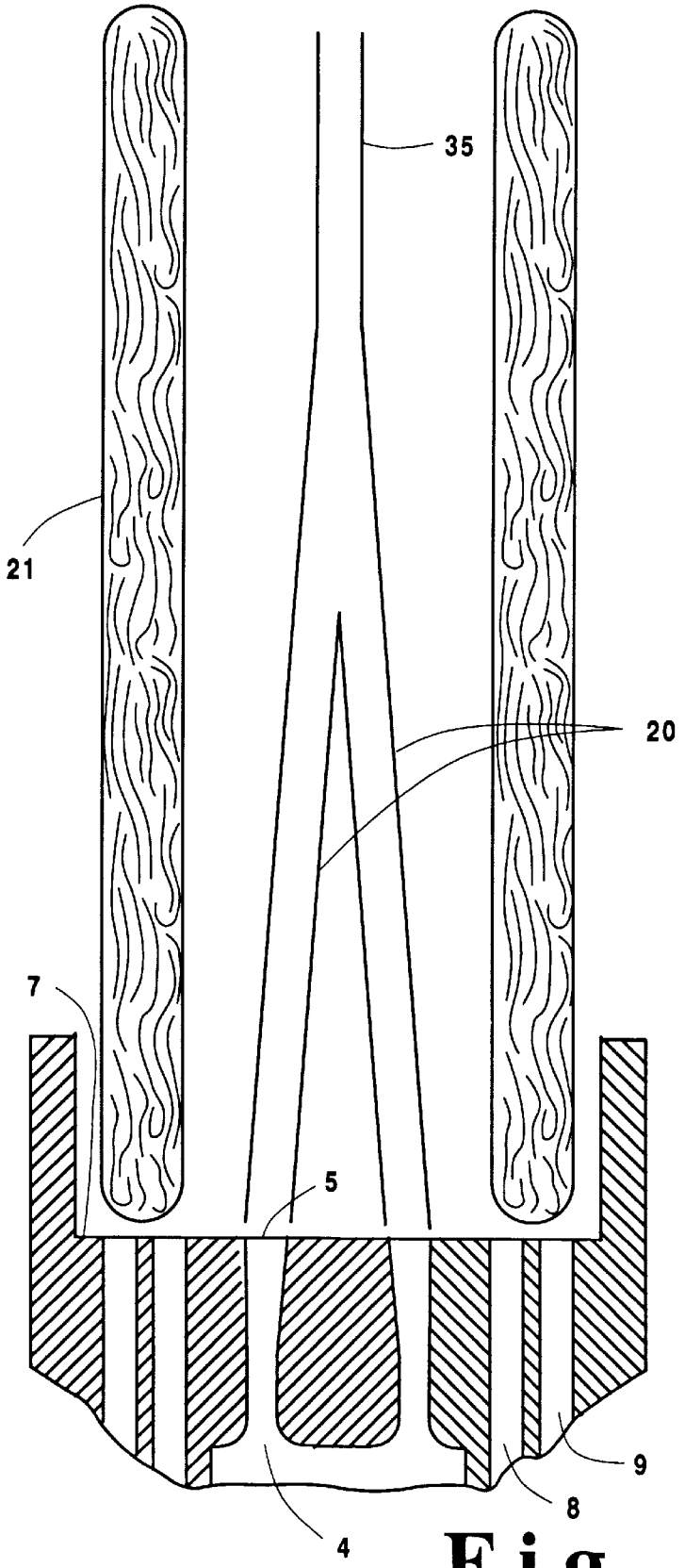
FIG. 2 is a cross sectional view of the lance end illustrated in FIG. 1 in operation.

The invention will be described in detail with reference to the Drawings. Lance 1 has an end or tip section 2 housing a plurality of nozzles 3. FIGS. 1 and 2 illustrate a preferred embodiment of the invention wherein the nozzles are each converging/diverging nozzles. Each of the nozzles 3 has an input opening 4 and an output opening 5. Preferably, as illustrated in FIGS. 1 and 2, the nozzle output openings are flush with lance face 7. Preferably the nozzle openings are circular, although other shapes, such as elliptical nozzle openings, may be used. The input openings 4 each communicate with a source of gas. In the embodiment illustrated in FIG. 1 each of the input openings 4 communicate with a different source of gas. For example, one of the input openings could communicate with a source of oxidant and another with a source of fuel. Alternatively one or more of the input openings 4 could communicate with the same gas source. Among the gases which could be used in the practice of this invention for ejection from a nozzle one can name air, oxygen, oxygen-enriched air, nitrogen, argon, carbon dioxide, hydrogen, helium, gaseous hydrocarbons, other gaseous fuels and mixtures comprising one or more thereof.

As illustrated in FIGS. 1 and 2 the nozzles are oriented in the lance end with their axes or centerlines at an inward angle A to the axis or centerline of the lance. Angle A may be up to 45 degrees or more and preferably is in the range of from 0.5 to 5 degrees, most preferably within the range of from 0.5 to 2 degrees. Preferably the throat diameter of the nozzles is within the range of from 0.2 to 2.0 inches and the diameter of output openings 5 is within the range of from 0.3 to 3.0 inches.

Gas is ejected out from each of the nozzle output openings 5, preferably at a supersonic velocity and generally within the range of from 500 to 10,000 feet per second (fps), to form a plurality of gas jets 20.

Figure 3:
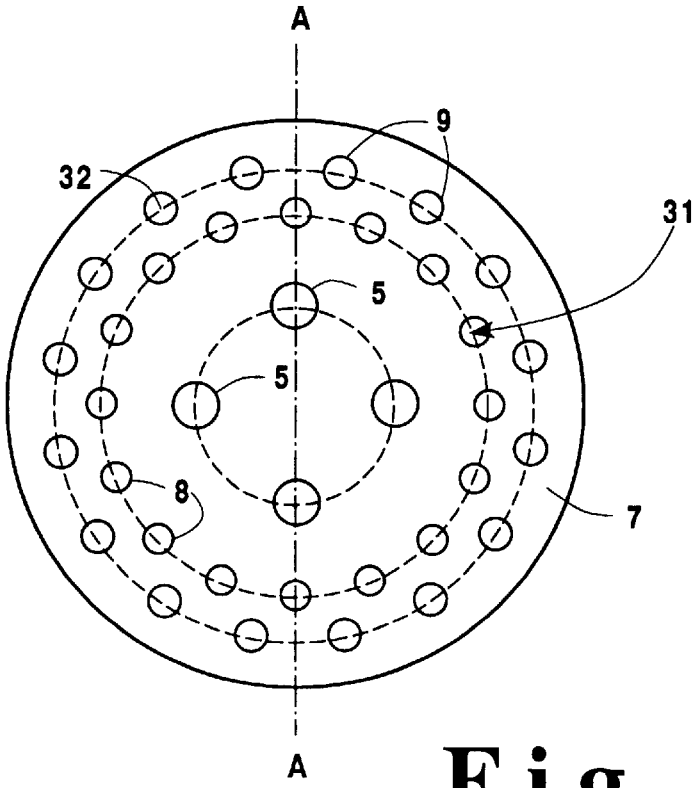
FIG. 3 is a head on view of a lance end in accordance with FIG. 1 having four nozzles in a circular arrangement.
Figure 4:
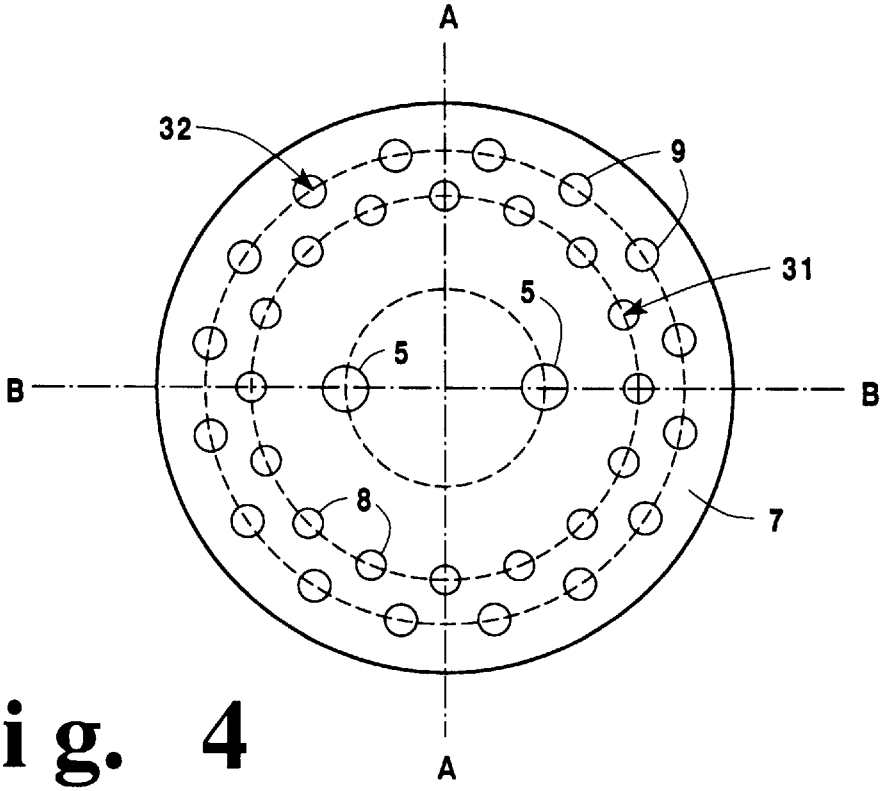
FIG. 4 is a head on view of a lance end in accordance with FIG. 1 having two nozzles.

The lance end also has at least one ejection means, preferably an annular ejection means, for passing at least one gas stream out from the nozzle, preferably concentrically around the plurality of gas jets. The gas stream or streams passed out from the ejection means can be in any effective shape. When one annular ejection means is employed the concentric gas stream preferably comprises a mixture of fuel and oxidant. In one embodiment of the invention the injection means may provide only fuel, and the oxidant needed for the combustion with the fuel to form the flame envelope may come from air entrained into the fuel stream or streams. Preferably, as illustrated in FIGS. 1 and 2, the lance end has a first annular ejection means 8 and a second annular ejection means 9 for passing respectively fuel and oxidant out from the lance in two concentric streams. The lance end also preferably has an extension 30 at its periphery. The fuel may be any fluid fuel such as methane, propane, butylene, natural gas, hydrogen, coke oven gas, or oil. The oxidant may be a fluid having an oxygen concentration which exceeds that of air. Preferably the oxidant is a fluid having an oxygen concentration of at least 30 mole percent, most preferably at least 50 mole percent. Preferably the fuel is provided through the first annular ejection means and the oxidant is provided through the second annular ejection means when oxygen is a gas ejected from at least one of the nozzles. When inert gas is ejected from the nozzles, preferably the oxidant is provided through the first annular ejection means and the fuel is provided through the second annular ejection means. Although one or both of the annular ejection means may form a continuous ring opening on lance face 7 from which the fuel or oxidant is ejected, preferably, as illustrated in FIGS. 3 and 4, both the first and second annular ejection means form a series of discrete openings, e.g. circular holes, from which the two concentric streams of fuel and oxidant are ejected. The ejection means need not provide fuel and oxidant completely around the gas jets.

The first annular ejection means at the lance end face forms a ring 31 around the plurality of nozzle output openings and the second annular ejection means at the lance end face forms a ring 32 around the first annular ejection means. The fuel and oxidant passed out of the first and second annular ejection means combust to form a flame envelope 21 around the plurality of gas jets 20 which then converge to form single coherent gas jet 35. Preferably gas jet 35 has a supersonic velocity and most preferably retains a supersonic velocity for its entire length. If the environment into which the fuel and oxidant is injected is not hot enough to auto ignite the mixture, a separate ignition source will be required to initiate the combustion. Preferably the flame envelope is moving at a velocity less than that of the gas jets and generally at a velocity within the range of from 300 to 1000 fps.

Figure 5:
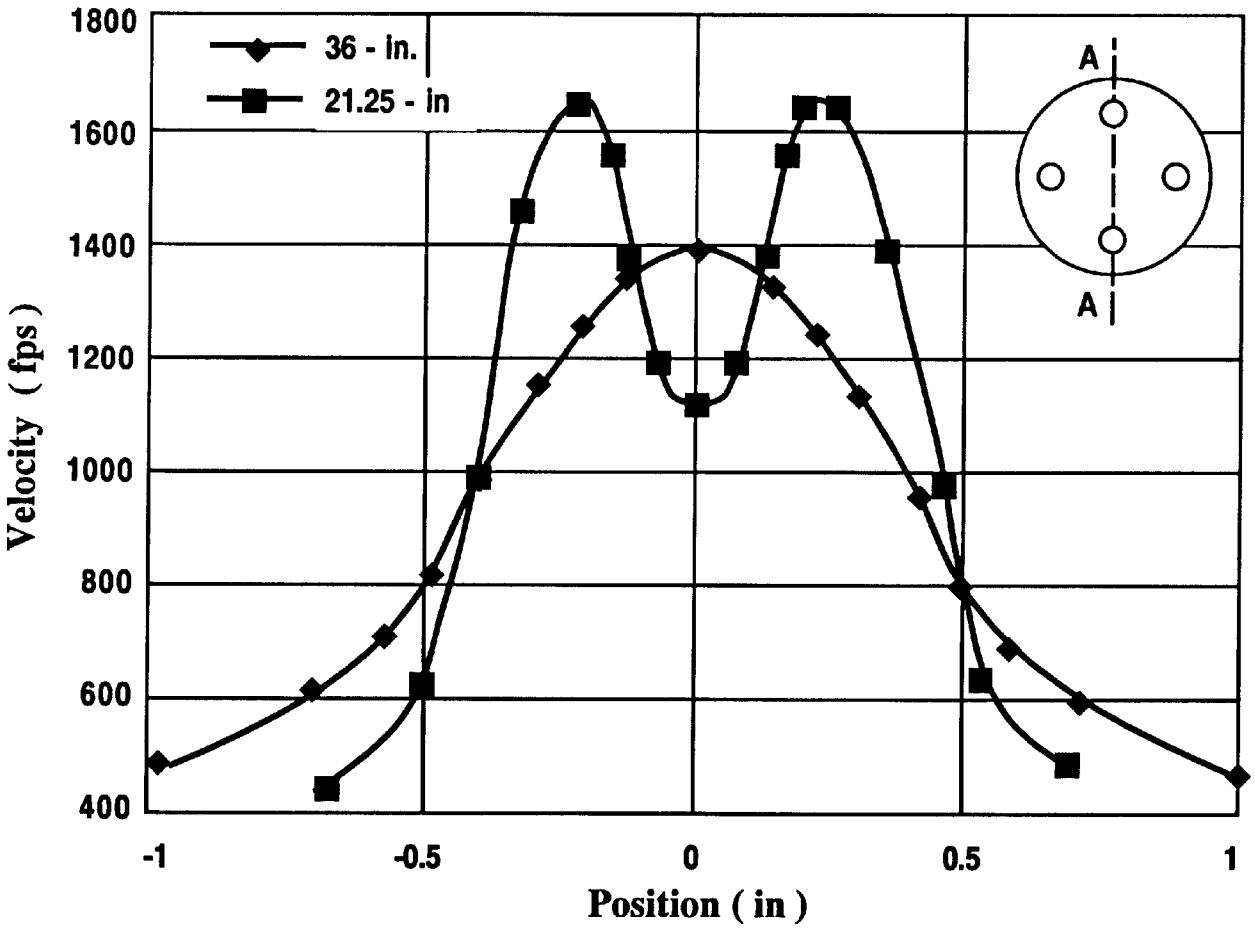
FIGS. 5 and 6 are graphical representations of test results achieved using the invention.
Figure 6:
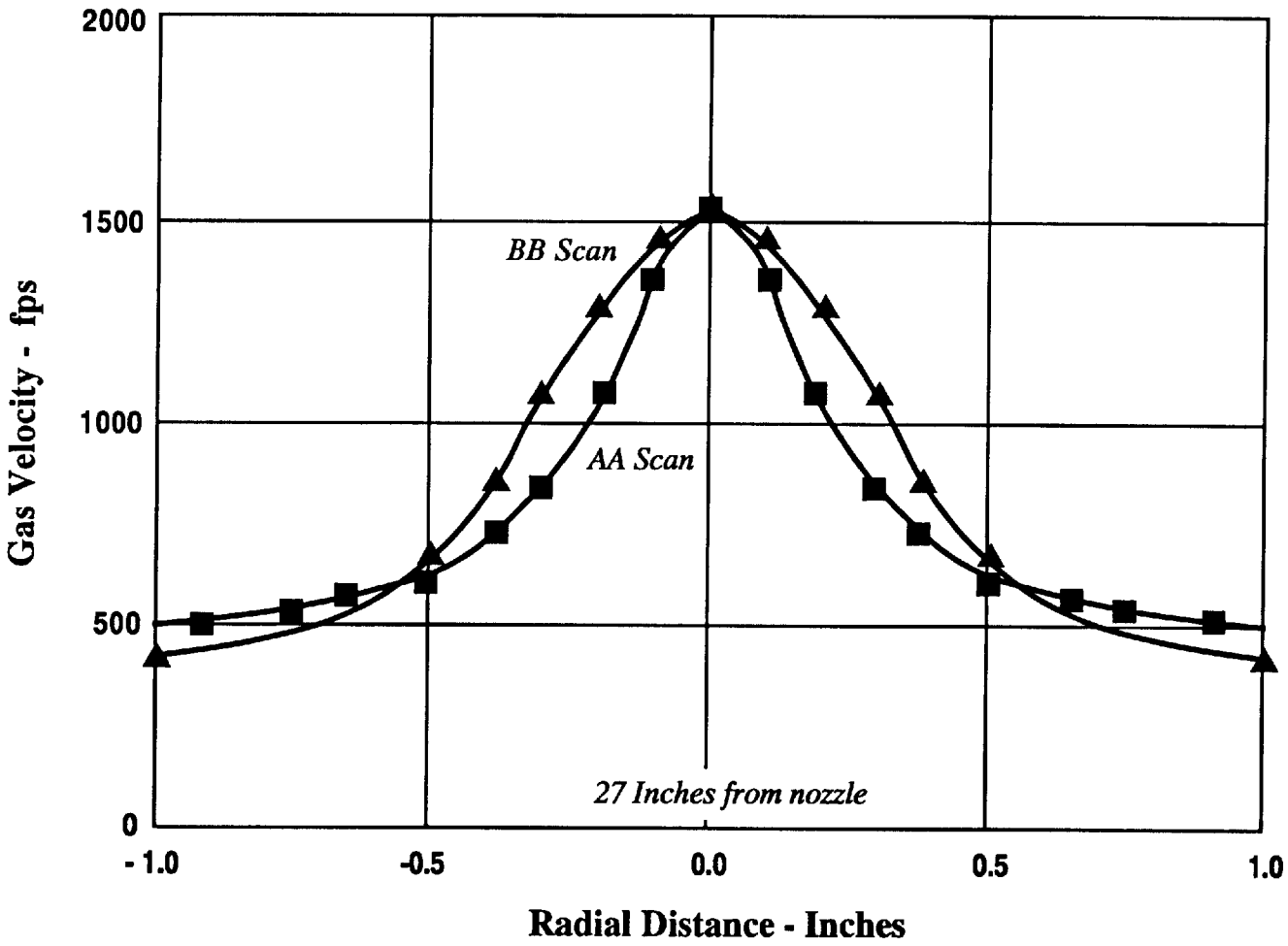

Tests were carried out to demonstrate the effectiveness of the invention using embodiments of the invention similar to that illustrated in the Figures. For the four nozzle embodiment, each nozzle had a centerline angled inward 1.5 degrees from the lance axis and the distance on the lance face between the centerlines of the nozzles was 1.5 inches. The results using the four nozzle embodiment illustrated in FIG. 3 are shown in FIG. 5 and the results using the two nozzle embodiment illustrated in FIG. 4 are shown in FIG. 6. For the two nozzle embodiment each nozzle had a centerline angled inward 2 degrees from the lance axis and the distance on the lance face between the centerlines of the two nozzles was 0.75 inch. Each nozzle was a converging/diverging nozzle with a throat diameter of 0.27 inch and an output or exit diameter of 0.39 inch. Oxygen gas was provided through each nozzle at a flowrate of 10,000 cubic feet per hour (CFH) at a supply pressure upstream of the nozzle of 150 pounds per square inch gauge (psig) to form either two or four coherent gas jets each having a supersonic velocity of about 1700 fps. A flame envelope was provided by flowing natural gas and oxygen from two rings of holes around the nozzles on the lance face. Natural gas at a flowrate of 5000 CFH was supplied through an inner ring of holes (16 holes, each having 0.154 inch diameter on a 2.5 inch diameter circle for the four nozzle embodiment and on a 2 inch diameter circle for the two nozzle embodiment), and oxygen at a flowrate of 4000 CFH was supplied through an outer ring of holes (16 holes, each having a 0.199 inch diameter on a 3.0 inch diameter circle for the four nozzle embodiment and on a 2.75 inch diameter circle for the two nozzle embodiment). The flowrates are given in CFH at NTP.

Velocity profiles 21.25 and 36 inches from the lance face are shown in FIG. 5 for the FIG. 3 embodiment and at 27 inches from the lance face for the FIG. 4 embodiment. Profiles were obtained for a plane (identified as AA as shown in FIGS. 3 and 4) perpendicular to the lance face at its axis and a plane (identified as BB as shown in FIG. 4) perpendicular to both the lance face and the plane AA. As the initial coherent jets interacted, they formed a single coherent jet. For the four nozzle embodiment there are shown individual coherent jets 21.25 inches from the lance face and a single coherent jet 36 inches from the lance face (FIG. 5). For the two nozzle embodiment, at 27 inches from the lance face (FIG. 6), the single jet cross section was essentially circular. The single jet formed from the two converging jets was coherent 27 inches from the lance face with supersonic velocities at the jet core.

The invention may be used, for example, to provide oxygen and natural gas for heating a molten bath efficiently. One or more of the initial jets could be of natural gas and one or more of the initial jets could be oxygen. The jets would merge to form a single coherent jet containing both oxygen and natural gas. This single coherent jet would be directed towards a molten metal bath. Because the jets would be coherent both before and after merging, mixing and combustion of the gases from the initial jets would be minimal until the single coherent jet penetrated the metal bath. At the molten metal bath, the natural gas and oxygen would mix and combust. This would be a very efficient way of heating the molten metal bath. The heat release from the heat of combustion would take place in very close proximity to the metal bath so that heat transfer from the combustion to the metal should be very effective.

The invention may also be used, for example, to effectively provide powders into a molten metal bath wherein the powders would be injected at the lance face and axis and provided into the molten metal bath as part of the resulting single coherent jet.

Although the invention has been described in detail with reference to certain preferred embodiments, those skilled in the art will recognize that there are other embodiments within the spirit and the scope of the claims.

What is claimed is:

1. Apparatus for establishing a single coherent jet from a plurality of gas streams, said apparatus comprising a lance having an axis and having an end with a plurality of nozzles, each of said nozzles having an axis at an inward angle to the lance axis, and means for passing both fuel and oxidant out from the lance peripheral to said plurality of nozzles.

2. The apparatus of claim 1 wherein said plurality is within the range of from two to four.

3. Apparatus for establishing a single coherent jet from a plurality of gas streams, said apparatus comprising a lance having an axis and having an end with a plurality of nozzles, each of said nozzles having an axis at an inward angle to the lance axis, and means for passing fuel and oxidant out from the lance peripheral to said plurality of nozzles comprising a first ring of holes around the nozzles on the lance face for the flow of oxidant and a second ring of holes around the first ring of holes on the nozzle face for the flow of fuel.

4. The apparatus of claim 3 wherein said plurality is within the range of from two to four.

5. A method for establishing a single coherent gas jet from a plurality of gas streams comprising:

(A) providing a lance having an axis and having an end with a plurality of nozzles, each of said nozzles having an output opening for passing gas from the nozzle;

(B) passing gas in a jet out from each nozzle output opening and forming a plurality of initial coherent gas jets, each initial coherent gas jet flowing from a nozzle output opening at an inward angle to the lance axis;

(C) passing fuel and oxidant in at least one stream out from the lance end and combusting the said fuel with the said oxidant to form a flame envelope around the plurality of initial coherent gas jets;

(D) flowing the plurality of initial coherent gas jets together and forming a single coherent gas jet from the plurality of initial coherent gas jets; and (E) extending the flame envelope from around the plurality of initial coherent gas jets so as to be around the single coherent gas jet wherein at least one of the plurality of initial coherent gas jets comprises a gas which differs from the gas which comprises at least one other of the plurality of initial coherent gas jets.

6. The method of claim 5 wherein the fuel and oxidant are passed respectively in two concentric streams out from the lance and around the plurality of initial coherent gas jets.

7. The method of claim 5 wherein each initial coherent gas jet has a supersonic velocity.

8. Apparatus for establishing a single coherent jet from a plurality of gas streams, said apparatus comprising a lance having an axis and having an end with a plurality of nozzles, each of said nozzles having an axis at an inward angle to the lance axis, and means for passing fuel and oxidant out from the lance peripheral to said plurality of nozzles comprising a first ring of holes around the nozzles on the lance face for the flow of fuel and a second ring of holes around the first ring of holes on the nozzle face for the flow of oxidant.

9. The apparatus of claim 8 wherein said plurality is within the range of from two to four.

10. A method for establishing a single coherent gas jet from a plurality of gas streams comprising:

(A) providing a lance having an axis and having an end with a plurality of nozzles, each of said nozzles having an output opening for passing gas from the nozzle;

(B) passing gas in a jet out from each nozzle output opening and forming a plurality of initial coherent gas jets, each initial coherent gas jet flowing from a nozzle output opening at an inward angle to the lance axis;

(C) passing fuel and oxidant in at least one stream out from the lance end and combusting the said fuel with the said oxidant to form a flame envelope around the plurality of initial coherent gas jets;

(D) flowing the plurality of initial coherent gas jets together and forming a single coherent gas jet from the plurality of initial coherent gas jets; and (E) extending the flame envelope from around the plurality of initial coherent gas jets so as to be around the single coherent gas jet wherein the resulting single coherent gas jet has a supersonic velocity.

11. The method of claim 1 wherein the fuel and oxidant are passed respectively in two concentric streams out from the lance and around the plurality of initial coherent gas jets.

12. The method of claim 1 wherein each initial coherent gas jet has a supersonic velocity.

13. The method of claim 1 wherein at least one of the plurality of initial coherent gas jets comprises a gas which differs from the gas which comprises at least one other of the plurality of initial coherent gas jets.

* * * * *